United States Patent [19]

Piper, Sr.

[11] 4,058,075

[45] Nov. 15, 1977

[54] MARINE LIFE GROWTH INHIBITOR DEVICE

[75] Inventor: Donald R. Piper, Sr., Tampa, Fla.

[73] Assignees: Ralph M. Guito, Jr.; Walter L. Hooper, both of Tampa, Fla.

[21] Appl. No.: 717,191

[22] Filed: Aug. 24, 1976

Related U.S. Application Data

[63] Continuation-in-part of Ser. No. 560,923, March 21, 1975, abandoned.

[51] Int. Cl.[2] ..... B63B 59/02

[52] U.S. Cl. ..... 114/222

[58] Field of Search ..... 114/67 R, 222; 259/1 R; 181/144, 156

[56] References Cited

U.S. PATENT DOCUMENTS

| | | | |
|---|---|---|---|
| 2,366,162 | 6/1945 | Vang | 114/67 R |
| 2,667,706 | 2/1954 | Morse et al. | 259/1 R |
| 3,089,562 | 5/1963 | Morgillo | 181/156 |
| 3,391,754 | 7/1968 | Montanaro | 181/149 |
| 3,947,635 | 3/1976 | Frankman | 181/144 |

FOREIGN PATENT DOCUMENTS

| | | | |
|---|---|---|---|
| 703,158 | 1/1954 | United Kingdom | 114/67 R |
| 719,650 | 12/1954 | United Kingdom | 114/67 R |

*Primary Examiner*—Trygve M. Blix
*Assistant Examiner*—Jesus D. Sotelo
*Attorney, Agent, or Firm*—Stefan M. Stein; Robert F. Frijouf

[57] ABSTRACT

A marine life growth inhibitor device is disclosed for inhibiting marine life on the outer surface of a submerged object such as a boat. The device includes a controller connected to a source of electrical power and a plurality of speakers electrically connected to the controller and attached at predetermined locations on the interior of the boat's hull, whereby vibrations may be transmitted through the hull. The controller may also include a transformer for reducing the voltage of the alternating current power source. Each of the plurality of speakers has a speaker diaphragm having a first and a second speaker diaphragm side. Each of the speakers is mounted in a speaker housing secured to the hull of the boat for enabling transfer of acoustical energy from both the first and second side of the speaker diaphragm to the boat hull to inhibit the growth of marine life on the exterior surface of the boat hull. The speakers are selected to produce acoustical vibration in the audible range.

8 Claims, 6 Drawing Figures

MARINE LIFE GROWTH INHIBITOR DEVICE

CROSS-REFERENCE OF THE INVENTION

This application is a continuation-in-part of prior application Ser. No. 560,923 filed Mar. 21, 1975, now abandoned.

BACKGROUND OF THE INVENTION

1. Field of the Invention

This invention relates to a marine life growth inhibitor device for inhibiting marine life growth on the submerged outer surface of a submerged article.

2. Description of the Prior Art

The problem of marine growth on submerged articles has long been recognized in the art. Particularly bothersome are organisms known as barnacles, which tend to attach to and/or deposit heavy calcium-like encrustations on boat hulls, screws, rudders, and virtually any submerged article. Of course, it is obvious that when barnacles attach themselves to the hull of a ship or boat, their presence materially detracts from the performance of the vessel. In recognition of the many problems created by the growth of barnacles on submerged ship surfaces, numerous devices and procedures have been devised for preventing such barnacle growth.

Perhaps the most well known method of preventing barnacle growth is the use of special paints or coatings on submerged boat surfaces. Some such coatings actually serve to halt barnacle growth for relatively short periods of time, while other less expensive such coatings merely slow the growth. Regardless of the particular type paint or coating utilized, certain inherent limitations have been observed. First, the boat must be completely removed from the water so that all submerged surfaces can be properly coated. Second, the coating is easily removed. While it is obvious that striking a submerged object would tend to chip and dislodge portions of the coating, it should also be noted that simply the friction of water rushing past the ship's hull will in time remove the coating. In recognition of the self-imposed limitations of paints and coatings, more sophisticated devices have been devised for preventing fouling of submerged articles by barnacle growth.

One such device is disclosed in U.S. Pat. No. 3,309,167, relating to an anti-fouling apparatus. That patent discloses an apparatus which prevents fouling of underwater equipment by heating the submerged external surface. According to the disclosure of that patent, barnacles cannot endure a temperature of over approximately 95° F. It is therefore the purpose of the apparatus of the patent to provide means whereby the boat's hull may be heated above that critical temperature. Of course, it should be obvious that such a device must be carefully installed, because surfaces of the boat are being heated, and those surfaces ae often in close proximity to the boat's bilges. This necessarily presents a fire hazard should any oil settle in those bilges.

U.S. Pat. Nos. 3,650,924 and 3,661,742, each relate to electrolytic methods for preventing fouling of ships by barnacle growth. Basically, each of these patents disclose an apparatus and method whereby sea water may be electrolyzed, and the decomposition products are discharged along the side of the ship. In U.S. Pat. No. 3,650,924, compressed air is also discharged along the sides of the ship so as to form a dense air blanket holding the electrolysis decomposition products adjacent the side of the ship. While both of these methods appear to be quite successful in controlling or preventing barnacle growth, it should be obvious that their installation would be limited to relatively large ships because of their complexity and cost. Additionally, both these methods require substantial maintenance, because the electrolysis decomposition products must be maintained along the surface to be protected.

Yet another method for preventing barnacle growth is disclosed in U.S. Pat. No. 3,837,916. That patent discloses the method of supplying fresh water on the surface of the submerged article to be protected. The barnacle organisms simply will not grow in the presence of fresh water, but such a method would seem extremely impractical for a large surface. While it would no doubt eliminate the growth of barnacles, to protect the entire submerged hull of even a relatively small fishing boat would require huge quantities of fresh water.

The use of vibration on a boat hull is disclosed in U.S. Pat. No. 2,366,162 and British Pat. Nos. 703,158 and 719,650. These patents teach the use of ultrasonic or supersonic vibration applied to the hull of the boat for causing various beneficial affects.

Accordingly, it is obvious that there is a need in the boat and ship industry for an apparatus and method of inhibiting marine life growth on submerged surfaces which is efficient, simple to install and maintain, and economical to operate. Such a device should preferably be of a type suitable for use on small fishing boats as well as large ocean-going vessels. It should also be capable of use and maintenance by the boat owner, only infrequently requiring technical adjustment and repair.

Therefore, it is an object of this invention to provide a marine life growth inhibitor device for use in combination with a boat hull comprising vibrator means including a speaker and a speaker housing adapted for directing acoustical energy from a speaker diaphragm to the inside surface of the boat hull to inhibit the growth of marine life on the exterior surface of the boat hull.

Another object of this invention is to provide a marine life growth inhibitor device for use in combination with a boat hull incorporating speakers adapted for transfer of acoustical energy in substantially only the audible range of frequency.

Another object of this invention is to provide a marine life growth inhibitor device for use in combination with a boat hull including a plurality of speakers electrically connected in series for terminating operation of the plurality of speakers upon an open circuit occurring in any one of the plurality of speakers.

Another object of this invention is to provide a marine life growth inhibitor device for use in combination with a boat hull comprising a speaker mounted in a speaker housing to enable constructive interference between acoustical energy propagating from the first and second sides of the diaphragm of the speaker.

Another object of this invention is to provide a marine life growth inhibitor device for use in combination with a boat hull including a speaker housing having a first and a second speaker housing portion with one of the housing portions having a housing diaphragm therein for enabling transfer of acoustical energy from a speaker mounted within the speaker housing to the hull of the boat.

Another object of this invention is to provide a marine life growth inhibitor device for use in combination with a boat hull including a speaker housing mountable to the inside surface of and below the normal water line of the boat hull and forming a water repellant speaker housing.

SUMMARY OF THE INVENTION

This invention relates to a device for inhibiting marine life growth on a submerged surface of an article such as a boat. As amply demonstrated by the prior art, it is well known that barnacles and the like will not grow in the presence of certain chemicals "painted" or "coated" onto a boat's hull. Similarly, barnacles will not adhere to surfaces which are constantly "washed" with those chemicals or with fresh water. It has now been determined that audible (20 Hz to 20 KHz) sound vibration provides an effective means of inhibiting such growth. Accordingly, the present invention relates to an apparatus and method comprising the transmission of vibrations through a boat's hull, thereby preventing barnacle growth thereon.

The marine life growth inhibitor device of this invention comprises a control means electrically connected to a source of power and a vibrator means electrically connected to the control means and attached at predetermined locations to the boat's hull. More specifically, in the preferred embodiment of the invention, the control means comprises a transformer connected to a standard source of 110 volt alternating voltage source. The transformer reduces the alternating voltage to preferably 25.2 volts, which is then passed to the vibrator means of the invention. The control means may be mounted either in the cockpit of the boat or below decks, as the owner desires.

The vibrator means of the invention comprise a plurality of speakers which are serially connected one to the other into the output of the control means. Each of the speakers is attached to the interior of the boat's hull below the water line. Alternating current passes from the control means to each of the speakers causing them to vibrate at approximately 50–60 cycles per second. These vibrations are transmitted through the boat's hull, efficiently inhibiting the growth of barnacles thereon and eliminating the need for other anti-fouling devices.

Each of the speakers has a speaker diaphragm including a first and a second speaker diaphragm side. The speakers are mounted in speaker housings for directing acoustical energy from both the first and second side of the speaker diaphragm to impinge upon the inside surface of the boat hull. The constructive interference of acoustical wave fronts from both the first and second side of the speaker diaphragm efficiently transfers the acoustical energy from the speaker diaphragm for inhibiting the growth of marine life on exterior of the boat hull. The speaker housing provides a water repellent enclosure for the protection of the speaker diaphragm.

While a detailed description of a preferred embodiment of the invention will be given hereinafter, certain factors relating to the invention must be kept in mind. First, while the invention contemplates the reduction of 110 volt alternating current to the required voltage, such is not necessary. That is to say, the control means may itself include the necessary source of current, thereby eliminating the need for a transformer.

Second, while the apparatus of this invention will be described as including vibrator means comprising speakers, it is to be understood that any suitable means of inducing vibrations of preferably 50–60 cycles per second may be utilized. Furthermore, the precise number and location of the vibrator means is dependent upon the size of the boat on which the device is installed and used. Each speaker has an area of coverage of approximately an eight foot diameter circle. However the invention is most effective when the circles overlap each other below the water line of the boat. The distance of external boat parts such as trim tabs, propellers, and the like must also be included as a part of the needed coverage.

Regardless of the boat's size, the speakers are preferably located approximately twelve inches inboard from the boat's chine rail with the first pair of speakers placed approximately four feet forward of the boat's transom. Subsequent speakers are then placed approximately eight to ten feet from each other along the boat's longitudinal dimension.

Finally, the control means of the present invention may further include an indicator light means and a fuse means. The fuse means prevents overloading the transformer, and the indicator light means provides a visual signal that the device is operating to transmit vibration through the boat's hull.

It is thus seen that the apparatus and method of the present invention provides a simple, safe and economical means of inhibiting marine life growth on the submerged surface of boats and ships. The device is capable of installation on both existing and new boat structures and eliminates the need of other costly and complex anti-fouling apparatus.

This invention accordingly comprises the several steps and the relation of one or more of such with respect to each of the others in the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
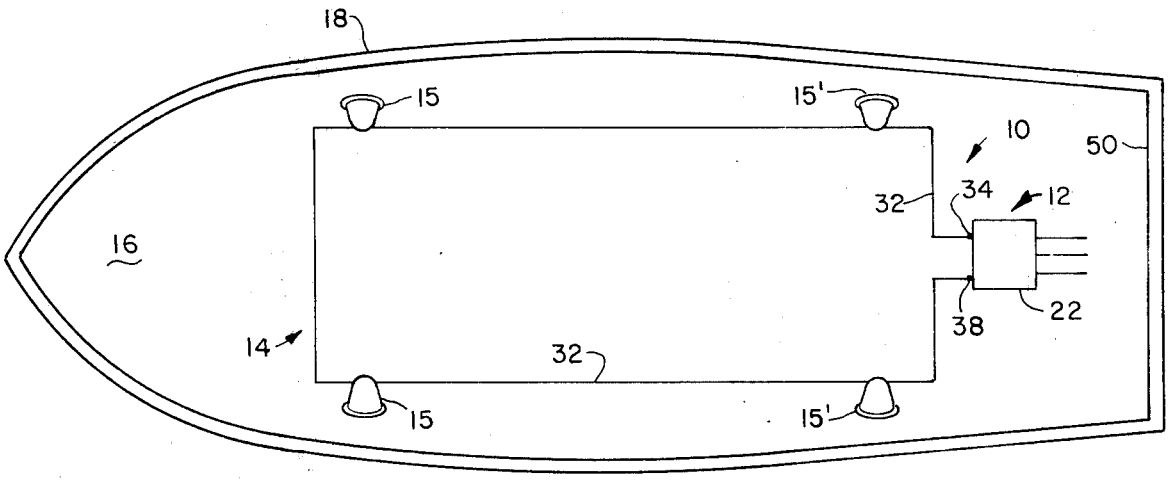
FIG. 1 is a plan schematic view showing the installation of the marine life growth inhibitor device on a boat hull.
Figure 2:
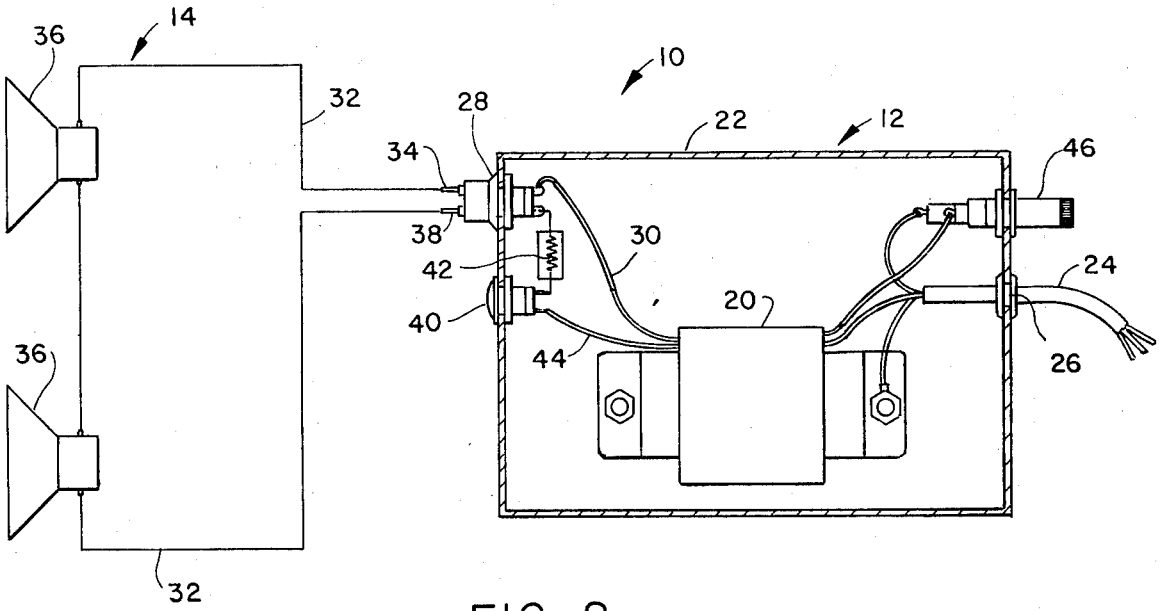
FIG. 2 is a detailed view of the control unit shown in FIG. 1 schematically connected to a plurality of speakers.

This invention relates to a marine life growth inhibitor device, generally indicated as 10 in FIGS. 1 and 2, and the attendant method for preventing such growth. As best seen in FIG. 1, device 10 comprises control means generally indicated as 12 and vibrator means generally indicated as 14 including speaker mounted in speaker housings 15. Device 10 preferably installed on the interior 16 of boat hull 18. It should further be noted that the installation shown in FIG. 1 is a schematic representation of the preferred embodiment for a boat of approximately 20 feet in length.

As best seen in FIG. 2, control means 12 basically comprises a step down transformer 20 enclosed within a controller casing 22. Transformer 20 is connected to a source of electrical energy by three-wire conduit 24 which passes through an aperture 26 formed in casing 22. The current output of transformer 20 is carried to terminal block 28 by conductor 30. This current is supplied to vibrator means 14 by connecting vibrator means connector 32 to output terminal 34.

The current is then carried in electrical series to speakers 36 which are contained in speaker housings 15 and back to return terminal 38 of terminal block 28. The electrical circuit is completed by connecting indicator means 40 with return terminal 38 by resistor 42, and then electrically connecting indicator means 40 with transformer 20 by conductor 44.

It should also be noted that the electrical circuit of device 10 is protected from overload by the provision of fuse means 46 connected in the primary circuit of transformer 20. Additionally, as best seen in FIG. 2, the circuit of device 10 further includes resistor 42 to prevent overloading of the speakers.

In the embodiment shown in FIG. 1 with specific regard to a 20 foot boat, the location of speaker housings 15 and 15' is as follows. Speaker housings 15' are positioned on the interior 16 of boat hull 18 approximately 4 feet forward of boat transom 50. Additionally, each of the speaker housings 15' are positioned approximately 12 inches inboard from the boat's chine rail. Speaker housings 15 are attached to hull 16 approximately 8 to 10 feet forward of speaker housings 15'. In larger boat installations, rearwardmost speaker housings 15' would be similarly positioned, and successive pairs of speaker housing 15 would be placed approximately 8 to 10 feet from each other along the boat's longitudinal dimension. In installations including more than four speakers, resistor 42 is replaced by a wire conductor. However, when a resistor is called for, as shown in FIG. 2, a twenty ohm resistor is preferable.

Figure 3:
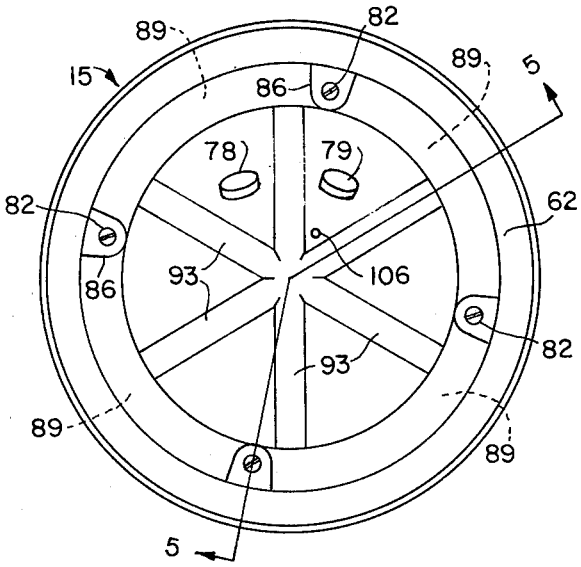
FIG. 3 is a top elevational view of a speaker housing shown in FIG. 1.
Figure 4:
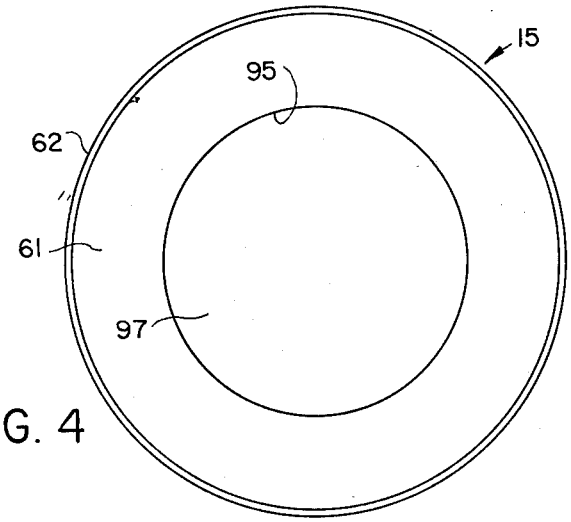
FIG. 4 is a bottom view of the speaker housing shown in FIG. 1 and FIG. 3.
Figure 5:
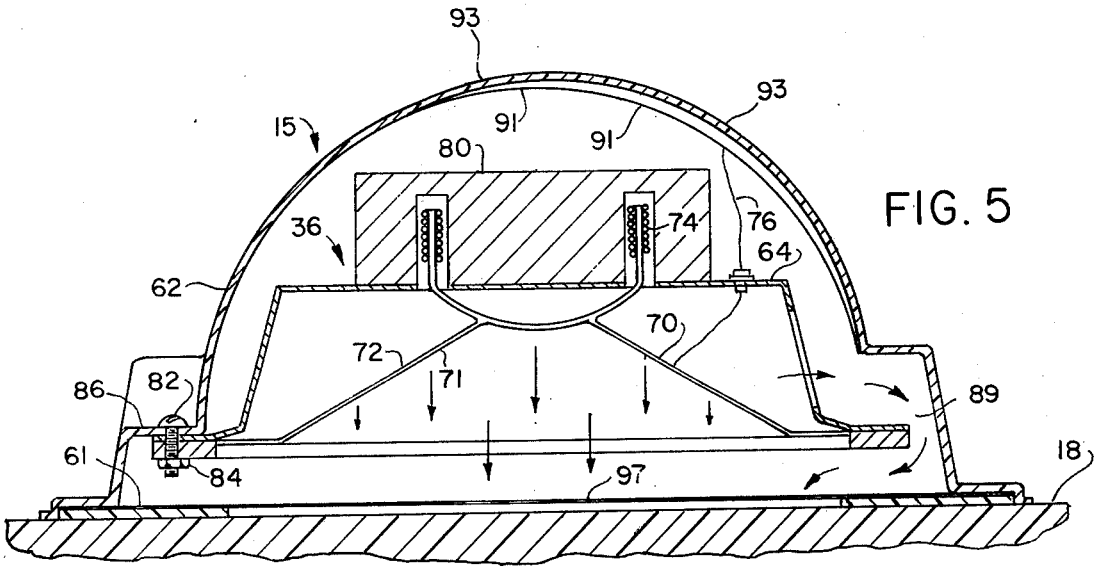
FIG. 5 is an enlarged side sectional view along line 5—5 of the speaker and speaker housing shown in FIGS. 1, 3 and 4.

FIGS. 3, 4 and 5 are respectively top elevational, bottom elevational and side sectional view of the speaker housings 15 and 15' shown in FIG. 1. The housing 15 may comprise a first and a second portion 61 and 62 securable to one another forming an enclosure for speaker 36. Speaker 36 includes a frame 64 suspending a speaker diaphragm 70 having a first and a second speaker diaphragm side 71 and 72. A voice coil 74 is attached to the diaphragm 70 and is connected through connectors one shown as 76 extending to one of the connector lugs 78 and 79 shown in FIG. 3. The voice coil 74 is located within a magnetic field established by permanent magnet 80 to provide transfer of electrical power to acoustical energy upon application of electrical power to lugs 78 and 79.

The speaker frame 64 is secured to the second portion 62 by a plurality of marine waterproof screws 82 threaded through apertures in the second portion 62. The frame 64 is secured to screws 82 by nuts 84. The second portion 62 includes a plurality of mounting bosses 86 for mounting speaker 36 to the second portion 62. The mounting bosses space the speaker frame 64 from the remainder of the second portion 62 creating an acoustical path 89 shown by the arrow in FIG. 5 and by the dashed lead lines in FIG. 3 about substantially all of the perimeter of the speaker frame 64.

The second portion 62 of the speaker housing 15 has a rounded region 91 which cooperates with the passage 89 to reflect acoustical wave fronts propagating from the second side 72 of the speaker diaphragm 70 to pass through passage 89 to reinforce the wave fronts propagating from the first side 71 of the speaker diaphragm 70. The passages 89 also reduce the acoustical loading of the speaker diaphragm 70. For example, if the second member 62 sealed the second side 72 from the first side 71 of the speaker diaphragm 70, then the limited volume of the rounded region 91 behind the second side 72 of the speaker diaphragm 70 would limit the acoustical output of the speaker diaphragm 70. The construction of the second portion 62 of the speaker housing 15 enables the wave fronts emanating from the second side 72 of the speaker diaphragm 70 to be reflected by the rounded region 91 and be phase changed thereby to propagate through passage 89 and constructively interfere with the wave fronts propagating from the first side 71 of the speaker diaphragm 70.

The second portion 62 may be vacuumed formed from ABS plastic or similar material with ribs 93 adding to the mechanical strength of the rounded region 91. The first member 61 include an aperture 95 for receiving a speaker housing diaphragm 97 for enabling acoustical transfer from the speaker diaphragm 70 through the speaker housing diaphragm 97 to the boat hull surface 18. The housing diaphragm 97 may be 0.015 inch polyethylene for example.

Figure 6:
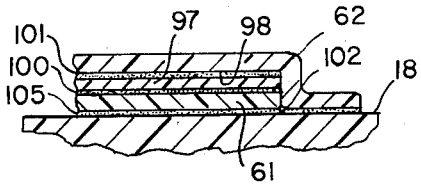
FIg. 6 is a magnified side sectional view of a portion of the speaker housing shown in FIG. 6

FIG. 6 is a magnified sectional view of a portion of FIG. 5 showing in greater detail the relationship between the first and second housing portions 61 and 62 and the housing diaphragm 97. The second member 62 has a recessed 98 for receiving the first housing member 61 in addition to the housing diaphragm 97. The housing diaphragm 97 is secured to the first member 61 by an adhesive 100 shown as double sided tape. The housing diaphragm 97 is secured to the second member 62 by adhesive 101. Additional adhesive 102 further seals the first and second housing portions 61 and 62 into a water repellent unit. The first and second housings are secured to the boat hull 18 by an adhesive 105. A bleeder hole 106 shown in FIG. 3 is sealed after the first and second speaker housings are secured to one another.

After the speaker housings 15 have been secured to the boat hull 18 as shown in FIG. 5 energizing voice coil 74 causes a movement of speaker diaphragm 70 enabling acoustical energy from the first and second side 71 and 72 of the speaker diaphragm 70 to propagate and be transferred by the speaker housing diaphragm 97 to vibrate the boat hull 18. The vibration of hull 18 under many conditions substantially eliminates all barnacle growth on the surface of the boat hull 18.

Test have been performed on boats of various construction using the aforementioned invention. Although the growth of barnacles is dependent in part on the temperature of the water it has been found that sound energy of over 70 db, as measured by placing a sound microphone against the hull, substantially eliminates all barnacle growth. Accordingly, speaker placement must be calculated to insure a 70 db noise level when the boat is located in warm waters. Less sound level is required for colder temperature water.

It should be emphasized that, in light of the environment in which device 10 is being utilized, all conduits and connections should be of a waterproof character.

As previously stated, control means 12 may be installed in virtually any location with respect to vibrator means 14. However, the boat's cockpit is preferred for each in monitoring the operational status of device 10. When device 10 is energized, the presence of a complete, operative circuit is indicated by illumination of indicator means 40. Because the entire circuit is series-connected, any break or malfunction in any element of device 10 will result in its inoperability.

When device 10 is energized, speakers 36 transmit vibrations of approximately 50–60 cycles per second through hull 18. It is these vibrations which have been found to be effective in inhibiting the growth of marine life such as barnacles.

It will thus be seen that the objects made apparent from the preceding description are efficiently attained, and since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

Now that the invention has been described,

What is claimed is:

1. A marine life growth inhibitor device primarily intended for use in combination with a boat hull, comprising in combination:

vibratory means comprising speaker means and speaker housing means for housing said speaker means, said speaker means including a speaker diaphragm having a first and a second speaker diaphragm side, said speaker diaphragm being moveable relative to said frame upon application of electrical power to said speaker means for transferring electrical energy into acoustical energy;

means for mounting said speaker means in said speaker housing means enabling acoustical energy to be directed from said second side of said speaker diaphragm adjacent the first side of the speaker diaphragm;

said speaker housing means including a first and a second speaker housing portion;

said first housing portion having a liquid impermeable housing diaphragm for enabling transfer of acoustical energy from said speaker diaphragm to the boat hull;

means for mounting said first and second housing portions and said housing diaphragm to form a water repellent speaker housing means;

means mounting said speaker housing means on the boat hull for enabling transfer of acoustical energy from said speaker diaphragm to the boat hull; and connection means for connecting said speaker means to an electrical power source to transfer acoustical energy from said speaker diaphragm to the boat hull to inhibit the growth of marine life on the exterior of the boat hull.

2. A device as set forth in claim 1, wherein said speaker means includes a speaker pair mounted on opposite sides of a central line of the boat hull.

3. A device as set forth in claim 1, wherein said electrical power source includes an alternating power source frequency in the audible range.

4. A device as set forth in claim 3, wherein said power source frequency includes 60 cycles per second.

5. A device as set forth in claim 1, wherein said speaker means includes a plurality of speakers; and said connection means including means connecting said plurality of speakers in electrical series for terminating operation of said vibratory means upon an open circuit in any one of said plurality of speakers.

6. A device as set forth in claim 1, wherein said speaker means includes a speaker frame moveably mounting said speaker diaphragm; and said means mounting said speaker means includes means for mounting said speaker frame to said speaker housing means with an acoustical passage established adjacent substantially all of the perimeter of said speaker frame.

7. A device as set forth in claim 1, wherein said speaker means is mounted in said speaker housing means to enable constructive interference between acoustical energy propagating from said first and second sides of said speaker diaphragm.

8. A device as set forth in claim 1, wherein said speaker housing means is mounted on the inside surface of and below the normal waterline of the boat hull.

* * * * *